United States Patent [19]

Butz

[11] 3,936,007

[45] Feb. 3, 1976

[54] PAPER LOG ROLLER

[75] Inventor: David E. Butz, Boston, Mass.

[73] Assignee: Belmont Industries, Incorporated, Reading, Mass.

[22] Filed: Oct. 3, 1974

[21] Appl. No.: 511,775

[52] U.S. Cl. ..... 242/67.1 R; 93/1 C

[51] Int. Cl.[2] ..... B65H 17/02

[58] Field of Search ..... 242/67.1 R, 66, 60; 93/1 C

[56] References Cited

UNITED STATES PATENTS

| | | | |
|---|---|---|---|
| 437,554 | 9/1890 | Bellamy | 242/60 |
| 2,350,758 | 6/1944 | Heuer | 242/67.1 R |
| 3,064,915 | 11/1962 | Hornstein | 242/66 |

*Primary Examiner*—Edward J. McCarthy

*Attorney, Agent, or Firm*—Robert T. Gammons

[57] ABSTRACT

A device for winding sheet material such as newspaper into a coil to form a combustible fireplace log comprising a base on which there is mounted a spindle for rotation parallel to the base and movement perpendicular thereto, springs opposing perpendicular movement of the spindle relative to the base, and a crank for effecting rotation of the spindle.

12 Claims, 8 Drawing Figures

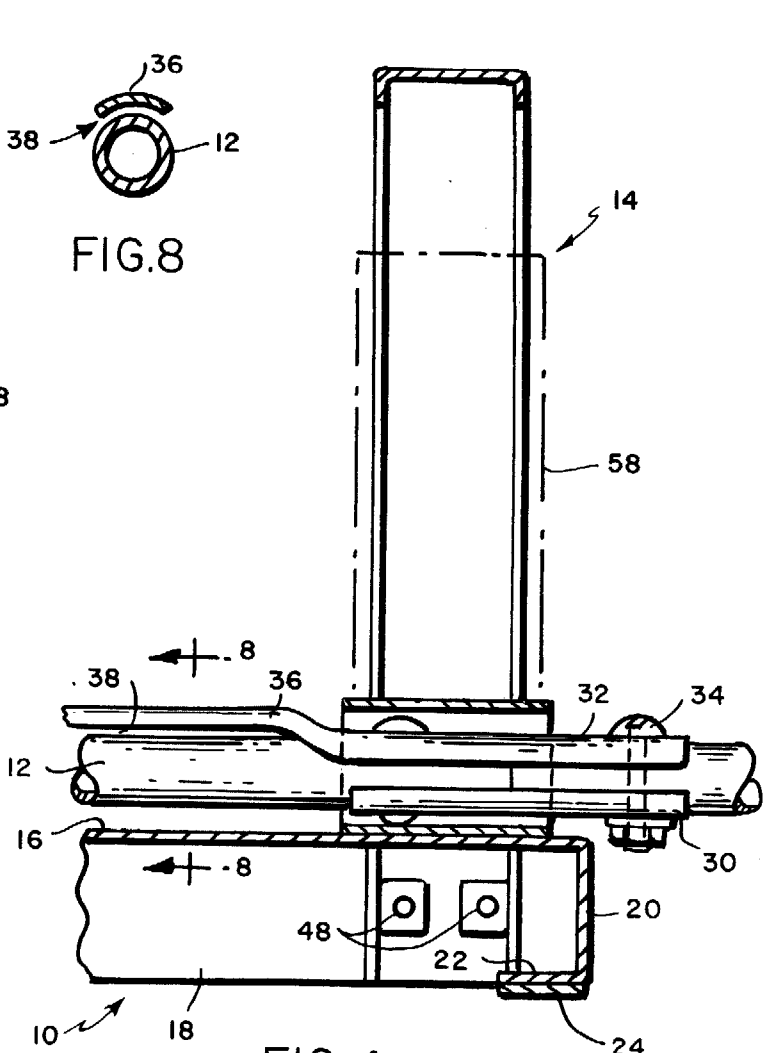
FIG.4
FIG.8
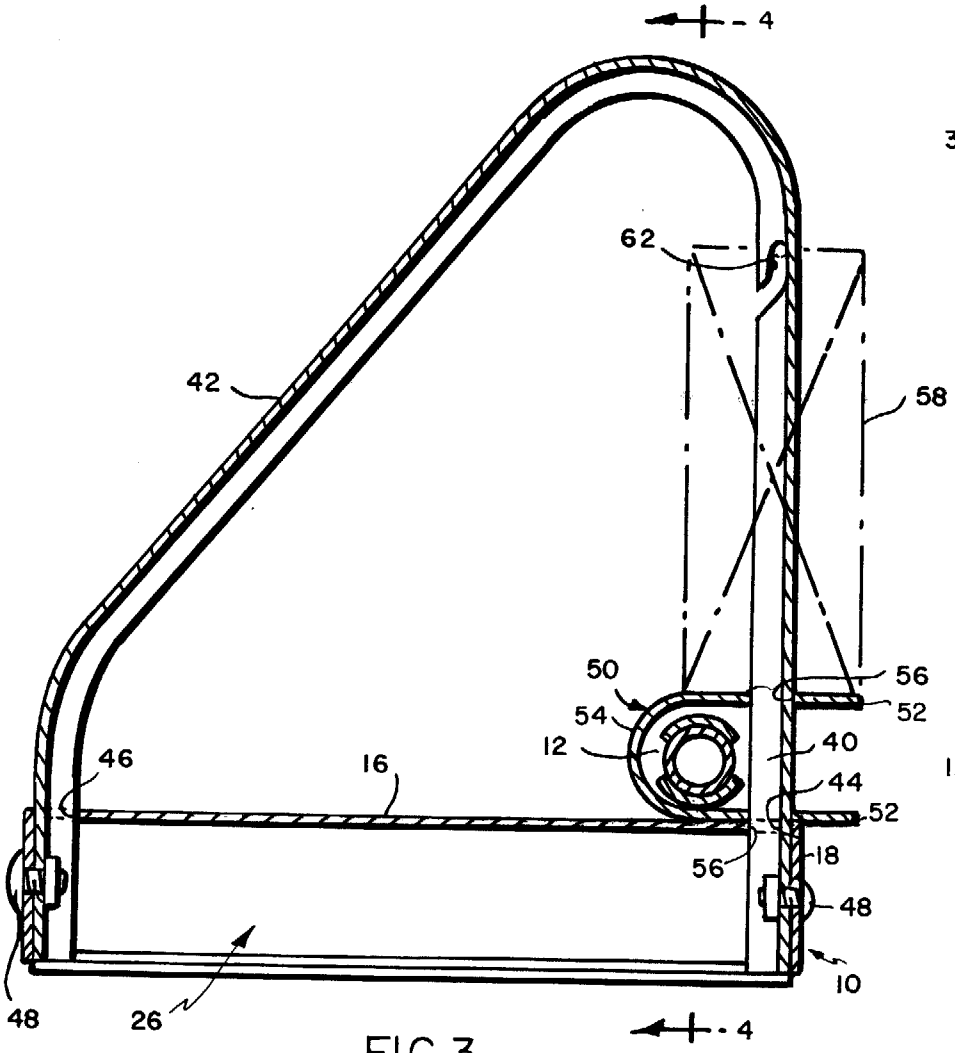
FIG.3

PAPER LOG ROLLER

BACKGROUND OF INVENTION

Apparatus for coiling newspapers and similar expendable sheet material to form fireplace logs is not new; however, that disclosed herein is considered to embody advantages in operation and construction over the prior art which constitute improvements in the art and in particular coiling of the sheet material in a tight coil for maximum long burn without pre-treatment of the sheet material and nesting of the dismantled parts for optimum packaging and shipment.

SUMMARY OF INVENTION

As herein illustrated the device comprises a spindle supported on a rigid base for rotation about its longitudinal axis parallel to the base and for movement perpendicular to the base, means yieldably opposing movement of the spindle perpendicular to the base, means on the spindle for connecting an end of sheet material to be coiled to the spindle and a crank at one end of the spindle to effect its rotation. The base has a flat top side and there are posts mounted to the top side at opposite ends. Bearing members are mounted on the posts for vertical sliding movement thereon perpendicular to the base, the bearing members containing openings and the spindle is rotatably mounted in the openings parallel to the base. Vertical movement of the bearing members is opposed by springs mounted on the posts with their lower ends engaged with the bearing members. The posts are provided with braces connected to their upper ends and at their lower ends to the base and are inclined relative to the base. The lower ends of the posts and braces are received in openings in the base and detachably connected to the base by screw bolts. The base has vertically arranged downwardly disposed side and end walls which define with the top a shallow receptacle and the legs, brace members, bearing members, springs, spindle and crank are designed to be stored in the receptacle provided by the base.

The invention will now be described with reference to the accompanying drawings, wherein:

FIG. 3 is a section taken on the line 3—3 of FIG. 1;

FIG. 4 is a fragmentary section taken on the line 4—4 of FIG. 3;

FIG. 8 is a section taken on the line 8—8 of FIG. 4.

Figure 2:
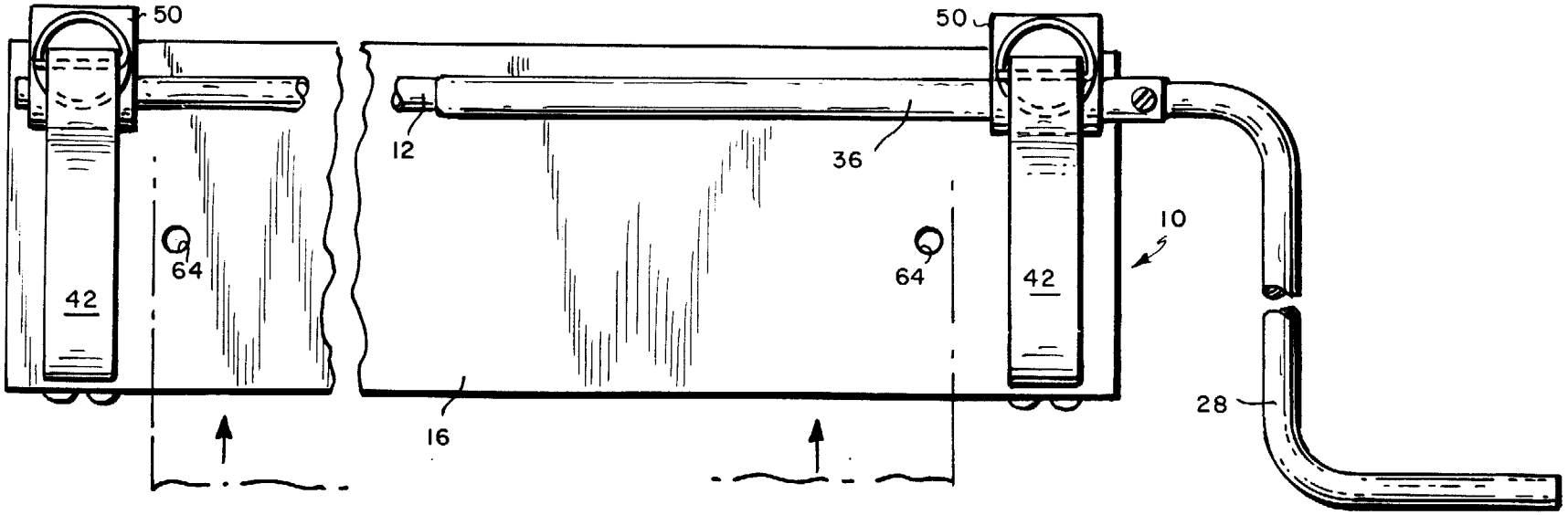
FIG. 2 is a plan view of FIG. 1.
Figure 1:
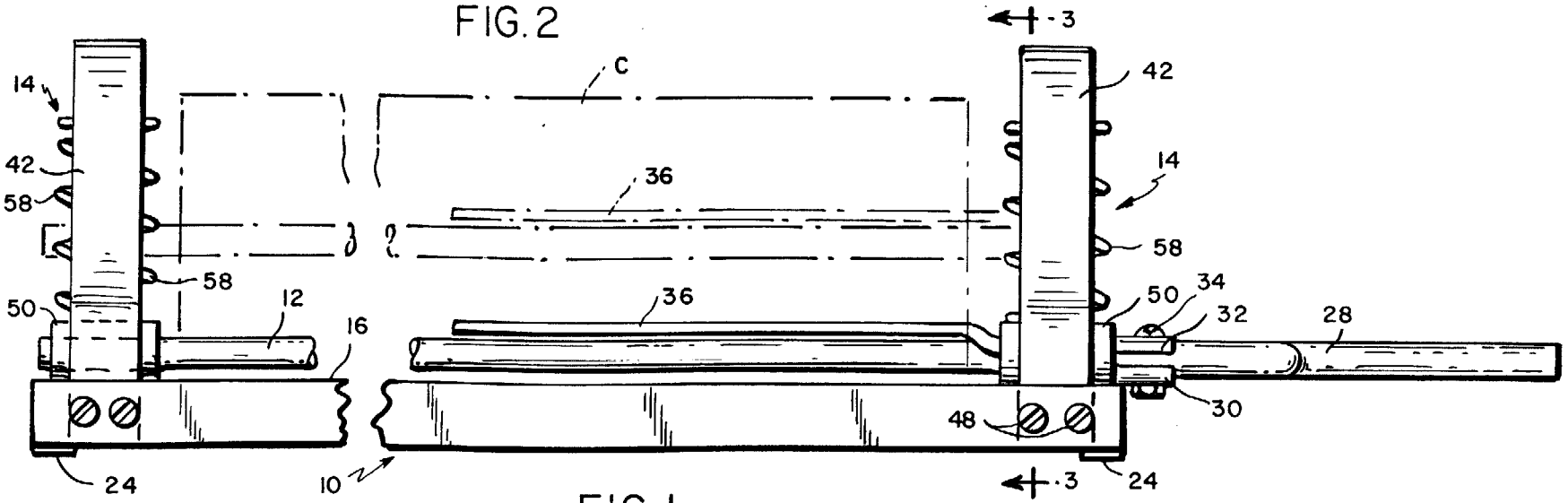
FIG. 1 is an elevation of the device.
Figure 7:
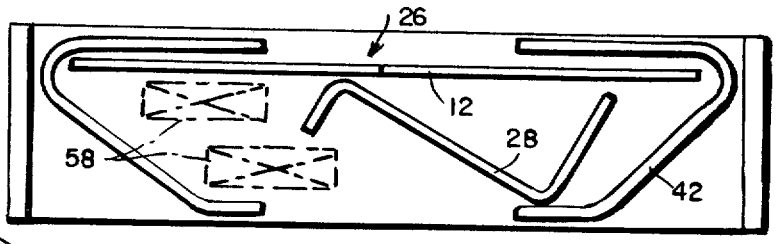
FIG. 7 shows the component parts of the device nested in the base.

Referring to the drawings, the device comprises an oblong base 10, a spindle 12 on which sheet material is to be wound to form a tight coil and means 14—14 at opposite ends of the base for supporting the spindle for rotation about its longitudinal axis parallel to the top of the base and for movement perpendicular thereto.

The base 10 is of a length greater than the width of the sheet material which is to be formed into a coil, wide enough to afford stability during the winding operation, and has a flat top surface 16, and vertically disposed, downwardly extending side and end walls 18—18 and 20—20. At the lower edges of the end walls there are inwardly bent foot plates 22—22 to which there are attached self-sticking resilient pads 24—24. The base is comprised of sheet metal and the top, side and end walls comprise a shallow receptacle 26 for receiving the component parts of the device as will appear hereinafter.

The spindle 12 comprises a rigid metal rod of circular cross section provided at one end with a crank 28. The crank 28 is detachably connected to the end of the spindle 12 by clamp members 30, 32 riveted to the spindle and bolted to the crank by means of screw bolts 34. The clamp 32 has an integral extension 36 in the form of a tine which is parallel to the spindle and spaced therefrom to provide a narrow slot 38 for receiving an end of the sheet materials between it and the spindle which is to be wound to form a coil on the spindle. The tine 36 is lenticular in cross section FIG. 8, so that its inner sides conform substantially to the curvature of the spindle and its outer side is convex so as to be easily withdrawn from the inside of the coil after winding.

The means 14—14 for supporting the spindle for rotation and for vertical movement relative to the base comprises vertical posts 40—40 and braces 42—42. The lower ends of the posts and braces are received in openings 44, 46, FIG. 3, at the top of the base at opposite ends and detachably fastened to the side walls by screw bolts 48. The upper ends of the legs and braces are integrally joined. The braces are inclined to the base so as to provide rigid supporting structures for the upper ends of the posts.

Figure 5:
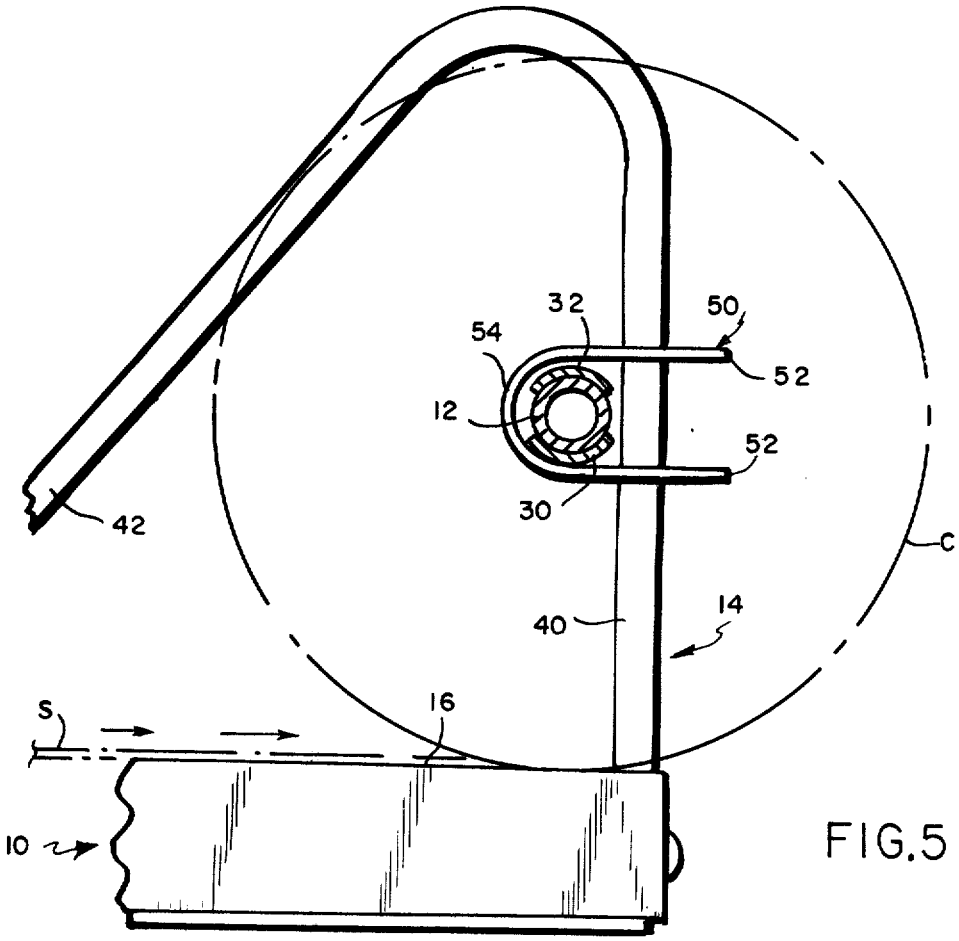
FIG. 5 is an elevation showing the position of the bearings when the coil is fully wound.

Bearing members 50—50, FIGS. 3 and 5, are mounted on the posts for vertical sliding movement thereon, each of which is U-shaped and has spaced parallel leg portions 52—52 and a bight portion 54. The leg portions 52—52 contain vertically aligned openings 56—56 for slidingly receiving the posts and the bight portion 54 is of sufficient diameter to rotatably receive the spindle. The bearing members are yieldingly held against the top of the base by coil springs 58—58 mounted on the posts above them with their lower ends engaged with the upper leg portions 56—56. The upper ends of the coil springs 58—58 are confined by engagement with portions of the upper ends of the springs with slots 62—62. Leaf springs arranged to bear upon the upper side of the bearing members 50—50 may be employed in lieu of the coil springs 58—58.

Figure 6:
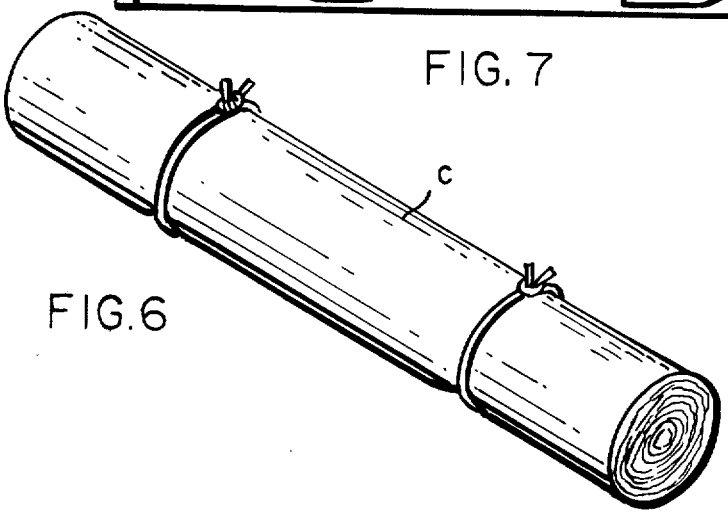
FIG. 6 shows a coil which has been wound, removed and tied.

Optionally, the base may contain openings 64—64, FIG. 2, for receiving bolts to attach it to a bench or the like. As thus constructed, the sheet material which is to be wound into the form of a coil is connected to the spindle by inserting its free end between the spindle and the tine and then rotating the spindle by means of the crank. As the coil builds up on the spindle the latter is permitted to rise in opposition to the spring pressure exerted by the coil springs on the posts so that the coil is wound tightly onto the spindle. When a coil sufficient size has been wound it is secured by suitable ties at one or more places lengthwise thereof whereupon the spindle is withdrawn axially from the coil and from its bearings so that the coil can be removed. A completed and tied coil C in the form of a fireplace log is shown in FIG. 6.

As previously related, the base provides a receptacle for the leg, brace members, spindle, crank, bearing members and springs which are so dimensioned that they can all be nested within the base as shown in FIG.

7 to form a package of no greater dimensions than that of the base. This is especially desirable from the standpoint of packaging the device for shipment and sale.

It should be understood that the present disclosure is for the purpose of illustration only and includes all modifications or improvements which fall within the scope of the appended claims.

I claim:

1. A device for coiling sheet material to form a combustible log, comprising a base having a top side, posts mounted to the top side of the base at opposite ends, bearing members mounted on the posts for vertical sliding movement thereon perpendicular to the base said bearing members containing bearing openings, a spindle rotatably mounted in said openings with its axis parallel to the base for rotation about an axis parallel to the base and for movement perpendicular to the base, spring means yieldably resisting movement of the bearing members perpendicular to the base, means on the spindle for connecting an end of the sheet to be coiled thereon to the spindle, and a crank at one end of the spindle for effecting rotation thereof.

2. A device according to claim 1, wherein the posts are detachably secured at their lower ends to the base.

3. A device according to claim 1, wherein the crank is detachably connected to the spindle.

4. A device according to claim 1, wherein the spindle may be slidingly removed from the bearing members by axial movement relative thereto.

5. A device for coiling sheet material to form a combustible log, comprising a rigid, substantially rectangular base having a top side, said base having at its top side at opposite ends transversely spaced openings, means at the opposite ends of the base comprising posts fixed at their lower ends in the openings at one side and brace members connected at one end to the upper ends of the posts and fixed at their other ends in the openings at the other side, said posts being perpendicular to the base, bearing members slidable vertically on the posts, coil springs mounted on the posts with their lower ends abutting the bearing members, means fixing the upper ends of the springs so that upward displacement of the bearing members is opposed, and a spindle rotatably mounted in the bearing members parallel to the base for rotation about its longitudinal axis to wind the sheet into a coil.

6. A device according to claim 5, wherein the braces are inclined relative to the base.

7. A device according to claim 5, wherein the upper ends of the legs and braces are integral.

8. A device according to claim 5, wherein the lower ends of the legs and braces are detachably bolted to the base.

9. A device according to claim 5, wherein a tine is mounted on the spindle in spaced parallel relation thereto for receiving an end of the sheet to be wound on the spindle.

10. A device according to claim 5, wherein the bearing members are U-shaped having legs pierced to slidingly receive the posts and bight portions for rotatably receiving the spindle.

11. A device according to claim 1, wherein the base has a flat top and perpendicularly disposed side and end walls which in conjunction with the top define a shallow receptable, and said legs, bearing members, springs, spindle and crank are designed to be stored within the receptacle provided for by the base.

12. A device according to claim 11, wherein there are inwardly directed flanges at the lower ends of the end walls parallel to the top and resilient pads attached thereto.

* * * * *